US006101940A

United States Patent [19]

Huff

[11] Patent Number: 6,101,940

[45] Date of Patent: Aug. 15, 2000

[54] PRINTING MACHINE

[75] Inventor: William H. Huff, Dallastown, Pa.

[73] Assignee: Ward Holding Co., Inc., Wilmington, Del.

[21] Appl. No.: 09/374,025

[22] Filed: Aug. 13, 1999

[51] Int. Cl.[7] ..... B41F 17/06

[52] U.S. Cl. ..... 101/213; 101/349.1; 101/350.1; 101/351.1; 101/351.3

[58] Field of Search ..... 101/213, 351.1, 101/351.2, 351.3, 351.4, 351.5, 349.1, 350.1, 352.01–352.09, 147, 148, 207, 208, 210

[56] References Cited

U.S. PATENT DOCUMENTS

| | | | |
|---|---|---|---|
| 3,107,608 | 10/1963 | Ward | 101/352 |
| 3,491,686 | 1/1970 | Zurick | 101/352.04 |
| 4,370,926 | 2/1983 | Hattori | 101/352.04 X |
| 4,528,907 | 7/1985 | Davison | 101/352.04 X |
| 4,711,174 | 12/1987 | Beisel | 101/352.04 X |
| 4,872,406 | 10/1989 | Kusch | 101/148 |
| 5,003,876 | 4/1991 | Harrison | 101/363 |
| 5,154,602 | 10/1992 | Harrison | 101/351 |
| 5,816,159 | 10/1998 | Chrigui | 101/350.01 |

*Primary Examiner*—John S. Hilten
*Assistant Examiner*—Minh H. Chau
*Attorney, Agent, or Firm*—Bartlett & Scherer; Ronald B. Sherer

[57] ABSTRACT

Two ink rolls in a flexographic printing machine are disclosed with a pivoted connection of the ink roll mounting elements such that one or other of the ink rolls may be engaged with the print cylinder.

6 Claims, 3 Drawing Sheets

PRINTING MACHINE

FIELD

This invention relates to printing machines, and more particularly, to a printing machine having a pair of pivoted ink rolls for selective engagement with the printing cylinder.

BACKGROUND

In modern printing there is often a need to change ink rolls such as for servicing, or for changing the type of ink roll for different printing requirements. For example, in flexographic printing, anilox ink rolls of different surface densities are required for different printing effects. In the past, it has been difficult and time consuming to remove one ink roll and substitute another, and such downtime is very costly to the printing company. Attempts to rotate different ink rolls into engagement with the print cylinder have been devised, such as in U.S. Pat. Nos. 5,081,928 and 5,154,602 assigned to the present Assignee. However, such rotating assemblies are complex and hence relatively costly.

SUMMARY

The present invention solves all of these serious problems by supporting first and second ink rolls in a pivoted assembly whereby either roll may be selectively and easily engaged with, and disengaged from, the print cylinder.

DETAILED DESCRIPTION

Figure 1:
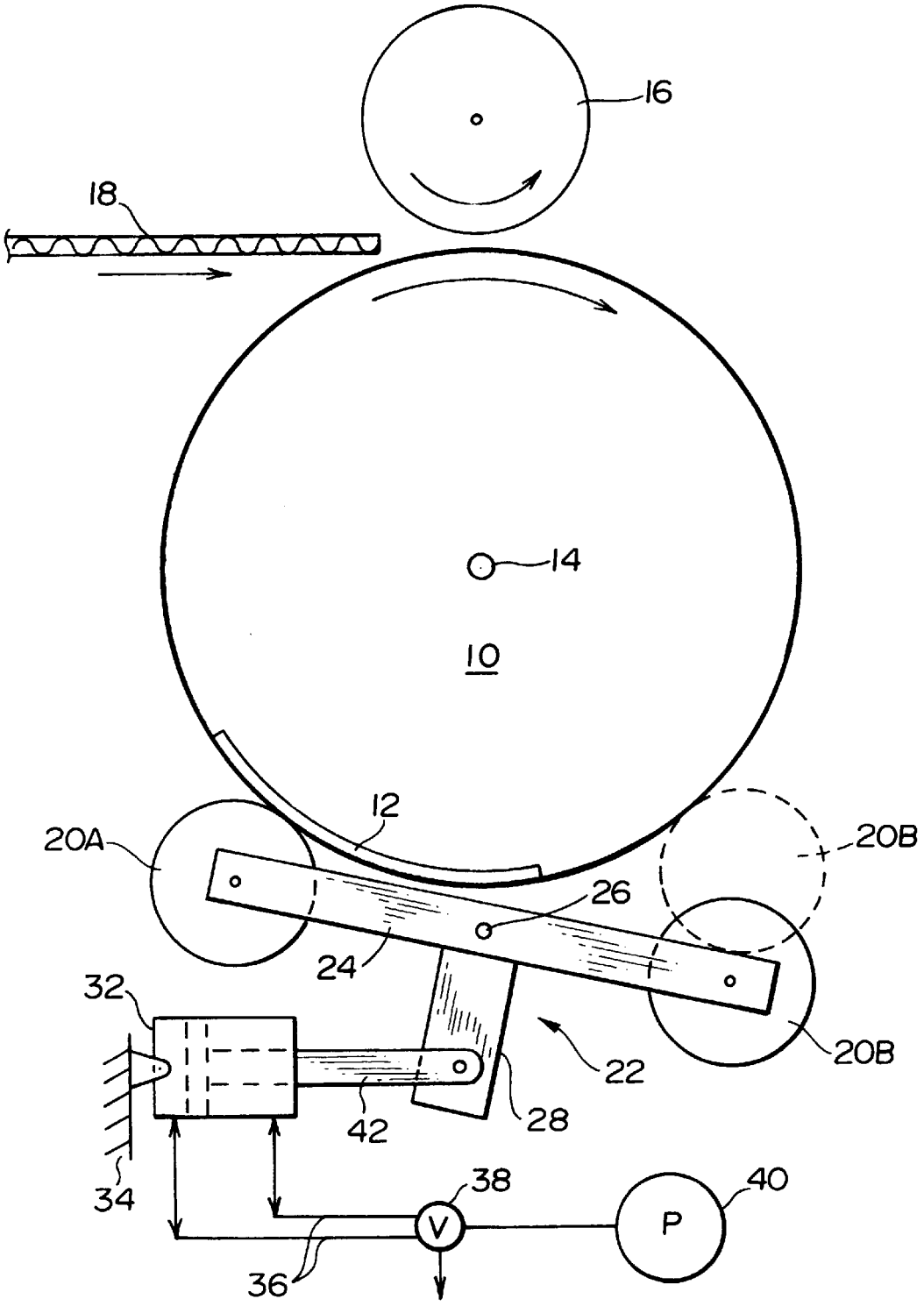
FIG. 1 is a schematic, elevational side view of one print cylinder and a pair of pivoted ink rolls.

Referring to FIG. 1, numeral 10 indicates a print cylinder carrying an inset printing plate 12 in one stage of printing. Print cylinder 10 rotates clockwise about shaft 14 and cooperates with impression cylinder 16 to imprint images and/or data on a plurality of sheets 18. Sheets 18 pass through the nip between print cylinder 10 and impression, or backup cylinder 16, and then pass on to other stages of multi-color printing, or to a die cutter or folder section. In the preferred embodiment, sheet 18 may be a sheet of corrugated cardboard on which advertising indicia is to be imprinted. Sheet 18 may then be cut and folded to become a container, or end-display, or other product of ultra high quality printed images.

In order to supply ink to printing plate 12, it is well known to employ anilox ink rolls. These are very high quality ink rolls which coat the print cylinder uniformly. However, some applications require a coarse anilox roll for a particular run of sheets, whereas the very next run of sheets may require a fine anilox roll. Therefore, with the prior art machines having only one ink roll per print cylinder, it has been necessary to remove and replace each ink roll for each job specification, as well as for cleaning and other servicing, or employ a complex and costly rotary system as previously described.

As illustrated in FIG. 1, the present invention solves this problem by mounting first and second inking rolls 20A and 20B at opposite ends of a simple pivoted assembly 22. It will be understood that the details of pivot assembly 22 may take many forms; however, for purposes of illustration, assembly 22 is shown as comprising a support element or beam 24 which is pivoted at point 26. Of course, it will be understood that a pivot assembly 22 is located at each of the opposite ends of rolls 20A and B, and that pivot 26 may be supported by the conventional side wall or other support structure of a conventional printing machine.

As further illustrated in FIG. 1, pivoted element 24 includes a portion 28 which extends at an angle to the longitudinal length of pivoted support element 24. Portion 28 is connected to the operating rod 42 of pneumatic or hydraulic power cylinder 32. Power cylinder 32 is secured to a stationary portion of the machine as shown schematically at 34. Power cylinder 32 is supplied with operating fluid through lines 36 and multi-position valve 38 from pump 40 such that rod 42 may be extended or retracted. As a result, ink roll 20A may be engaged with print plate 12 when rod 42 is retracted, as shown, or ink roll 20B may engage the print plate when rod 42 is extended. Of course, valve 38 may be electrically operated such that it and beam 24 may be operated by an electrical switch not shown.

Figure 2:
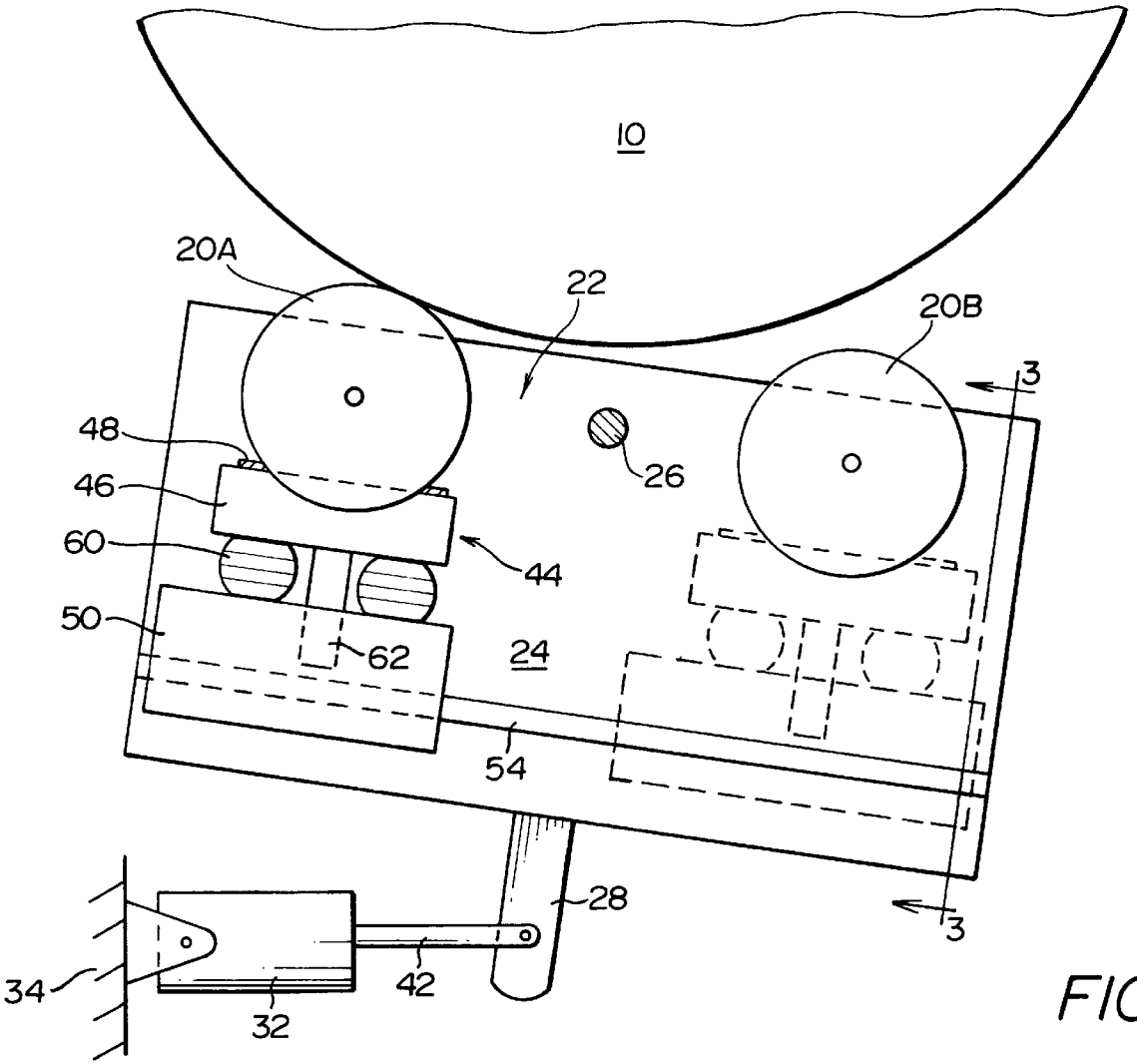
FIG. 2 is a schematic, elevational side view of a further embodiment.
Figure 3:
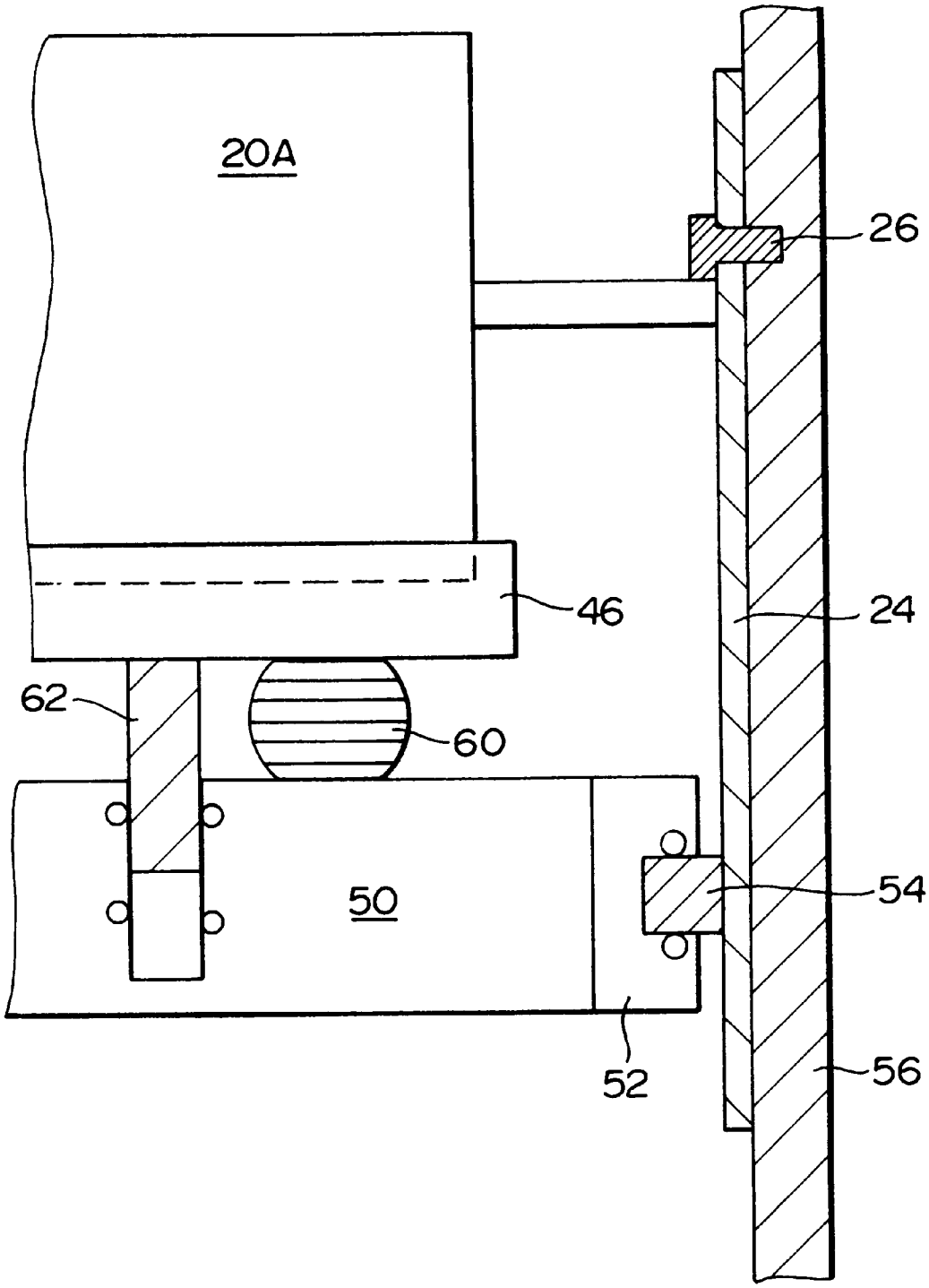
FIG. 3 is a cross-sectional view taken along view line 3—3 of FIG. 2.

In addition to providing a very quick and simple system for changing ink rolls as first described, in one preferred embodiment the present invention further includes the ability of the system to operate each of the two ink rolls with only one ink supply; the ink supplies not being shown in FIG. 1. This is illustrated in FIGS. 2 and 3 where the same elements are represented by the same numerals. In this embodiment, a single ink fountain 44 is provided, and fountain 44 includes a conventional ink tray 46 and conventional doctor blades 48. Fountain 44 is supported by support element 50 which is slidably mounted on a linear bearing 52 which slides along a track 54 secured to pivot plate 24 as shown most clearly in FIG. 3. As previously described, pivot plate 24 is pivotally mounted at 26 to a frame member 56 of the printing machine so that plate 24 may pivot and support 50 may slide so as to move the fountain to and from ink rolls 20A and 20B; the latter position of support 50 being shown in dotted line in FIG. 2.

From the foregoing description of one embodiment of the invention, it will be apparent that either of ink rolls 20A or 20B may be brought into contact with the print plate in a very simple and relatively low cost manner. However, there may also be operating conditions when it is desired to clean or otherwise service or exchange both ink rolls at the same time such that both rolls are desired to be out of engagement with the print cylinder. In one embodiment, power cylinder 32 may be operated with a mid-position between the positions described above so that both ink rolls are out of contact with the print cylinder. It is preferred that two or more fluid expandable elements 60, sometimes called "air bags", are provided between support 50 and ink tray 46 as shown in FIG. 2. Tray 46 is mechanically supported by one or more rods 62 which slide into and out of support 50 as expandable elements 60 are expanded and contracted by pneumatic or hydraulic pressure.

Support 50 and the entire ink tray and associated doctor blades may be moved along slide support 54 manually, or by a motor and gear drive, or pneumatically or hydraulically using well known and conventional components. As a result, different anilox or other ink rolls may be substituted with a push of one or more buttons, and also including repositioning of one ink tray and associated doctor blades.

From the foregoing description of several embodiments of the invention it will become apparent to those skilled in the art that many variations are apparent, and it is to be understood that the foregoing description is intended to be purely illustrative of the principles of the invention, and not limiting thereof, and that the legal scope of the invention is not to be limited other than as set forth in the following claims interpreted under the doctrine of equivalents.

What is claimed is:

1. A printing machine comprising:

(a) at least one printing cylinder;

(b) first and second ink rolls mounted adjacent first and second portions of said cylinder;

(c) pivoted mounting means for alternatively engaging said first and second ink rolls with said printing cylinder;

(d) an ink tray; and (e) slidable support means secured to said pivoted mounting means for slidably supporting said ink tray between a first position in contact with said first ink roll and a second position in contact with said second ink roll.

2. A printing machine comprising:

(a) at least one printing cylinder;

(b) first and second ink rolls mounted adjacent first and second portions of said cylinder;

(c) pivoted mounting means for alternatively engaging said first and second ink rolls with said printing cylinder, said pivoted mounting means comprising an elongated support element having spaced-apart ends, said elongated support element being pivotally mounted for arcuate movement of said ends of said elongated element, and said first and second ink rolls being supported at the ends of said elongated element;

(d) fluid actuated means, means connecting said fluid activated means to said elongated support element for pivoting said support element for engaging one or other of said ink rolls with said printing cylinder;

(e) an ink tray; and (f) slidable support means for moving said ink tray from a first position adjacent said first ink roll to a second position adjacent said second ink roll.

3. The printing machine of claim 2 including fluid expandable means for moving said ink tray toward and away from said printing cylinder.

4. In a flexographic printing machine the invention comprising:

(a) at least one rotary printing cylinder carrying a flexographic printing plate;

(b) ink roll means consisting of a pair of first and second ink rolls;

(c) vertically extending plate members;

(d) first and second means mounting said first and second ink rolls on said vertically extending plate members;

(e) pivot means mid-way between said first and second ink rolls for securing said plate member to the machine for pivoting said first and second ink rolls into and out of contact with said rotary print cylinder; and (f) a single ink tray means for alternatively engaging each of said first and second ink rolls.

5. The flexographic printing machine of claim 4 further including support means for supporting said single ink tray means for alternatively engaging each of said first and second ink rolls.

6. The flexographic printing machine of claim 5 wherein said support means comprise first support means connected to said plate member, and second support means connected to said ink tray and slidably mounted on said first support means.

* * * * *